US010583445B2

(12) United States Patent
Rogers et al.

(10) Patent No.: US 10,583,445 B2
(45) Date of Patent: Mar. 10, 2020

(54) CYCLONIC-ASPIRATING CARGO FIRE SUPPRESSION NOZZLE

(71) Applicant: Kidde Technologies, Inc., Wilson, NC (US)

(72) Inventors: Aaron Stanley Rogers, Surf City, NC (US); Dharmendr Len Seebaluck, Wake Forest, NC (US)

(73) Assignee: Kidde Technologies, Inc., Wilson, NC (US)

( * ) Notice: Subject to any disclaimer, the term of this patent is extended or adjusted under 35 U.S.C. 154(b) by 0 days.

(21) Appl. No.: 15/784,826

(22) Filed: Oct. 16, 2017

(65) Prior Publication Data

US 2019/0111444 A1 Apr. 18, 2019

(51) Int. Cl.

| | |
|---|---|
| ***B05B 1/26*** | (2006.01) |
| ***A62C 31/02*** | (2006.01) |
| ***A62C 5/00*** | (2006.01) |
| *A62C 3/08* | (2006.01) |
| *B05B 15/62* | (2018.01) |
| *B05B 15/65* | (2018.01) |

(52) U.S. Cl.

CPC ..... *B05B 1/265* (2013.01); *A62C 5/008* (2013.01); *A62C 31/02* (2013.01); *A62C 3/08* (2013.01); *B05B 15/62* (2018.02); *B05B 15/65* (2018.02)

(58) Field of Classification Search

CPC ..... B05B 1/265; B05B 15/62; B05B 15/65; A62C 31/02; A62C 3/08

USPC ..... 239/499, 500, 518, 524

See application file for complete search history.

(56) References Cited

U.S. PATENT DOCUMENTS

| | | | | |
|---|---|---|---|---|
| 3,029,030 | A * | 4/1962 | Dey, Sr. | B05B 1/265 239/520 |
| 3,708,015 | A | 1/1973 | Yao | |
| 6,102,308 | A | 8/2000 | Steingass et al. | |
| 6,557,785 | B1 | 5/2003 | Knapp | |
| 6,663,025 | B1 * | 12/2003 | Halsey | C23C 14/566 118/715 |
| 9,700,826 | B2 | 7/2017 | Kim et al. | |
| 2009/0178812 | A1 | 7/2009 | Solomon et al. | |
| 2012/0058264 | A1 | 3/2012 | Filou et al. | |
| 2014/0352698 | A1 | 12/2014 | Kim et al. | |

FOREIGN PATENT DOCUMENTS

WO WO2017097361 A1 6/2017

OTHER PUBLICATIONS

Extended European Search Report for European Patent Application No. 18200429.1, dated Mar. 21, 2019, 7 pages.

* cited by examiner

*Primary Examiner* — Christopher S Kim

(74) *Attorney, Agent, or Firm* — Kinney & Lange, P.A.

(57) ABSTRACT

A fire suppression nozzle includes a body including a cylindrical portion having a first end and a second end and a conical portion connected to the second end of the cylindrical portion, a main channel extending through the cylindrical portion, a flow deflector connected to the body, and a flow foil ring positioned adjacent the flow deflector and the conical portion of the body. The flow deflector includes a top portion in alignment with the main channel, an annular flange extending out of a side of the flow deflector, and a conical base extending out of the side of the flow deflector at an angle.

12 Claims, 4 Drawing Sheets

CYCLONIC-ASPIRATING CARGO FIRE SUPPRESSION NOZZLE

BACKGROUND

The present disclosure relates to nozzles, and in particular, to fire suppression nozzles.

Fire suppression nozzles are utilized to deliver fire suppression agent to a cargo hold of an aircraft. The nozzles typically penetrate a wall or ceiling in the cargo hold and have three or four orifices through which the fire suppression agent is distributed. When the suppression agent is introduced into the cargo hold, it exits out of the orifices in a high pressure stream and can accumulate in a localized area, resulting in uneven distribution of the agent from the fire extinguishing vessels. Additionally, debris may travel down pipes connected to the nozzles and plug the nozzle orifices.

SUMMARY

A fire suppression nozzle includes a body including a cylindrical portion having a first end and a second end and a conical portion connected to the second end of the cylindrical portion, a main channel extending through the cylindrical portion, a flow deflector connected to the body, and a flow foil ring positioned adjacent the flow deflector and the conical portion of the body. The flow deflector includes a top portion in alignment with the main channel, an annular flange extending out of a side of the flow deflector, and a conical base extending out of the side of the flow deflector at an angle.

A fire suppression nozzle includes a body, a main channel extending through the body, a flow deflector connected to the body, a flow foil ring between the flow deflector and the body, an annular outlet between the body and the flow foil ring, and an annular inlet between the flow foil ring and a conical base of the flow deflector.

DETAILED DESCRIPTION

In general, the present disclosure describes a nozzle for distributing fire suppression agent to a cargo hold of an aircraft, the nozzle having an annular outlet that allows 360 degree dispersion of the fire suppression agent. The nozzle also has a flow foil ring with a flat bottom and curved top, or airfoil shape, which accelerates flow of the agent and creates agent lift and suspension, reducing blockage. As a result, the nozzle also entrains ambient air through an annular inlet passage formed by a conical base of the flow deflector and the bottom of the flow foil ring to mix ambient air with the agent, reducing cargo hold over pressure risks and minimizing localized build ups of high agent concentration in the cargo hold.

Figure 1A:
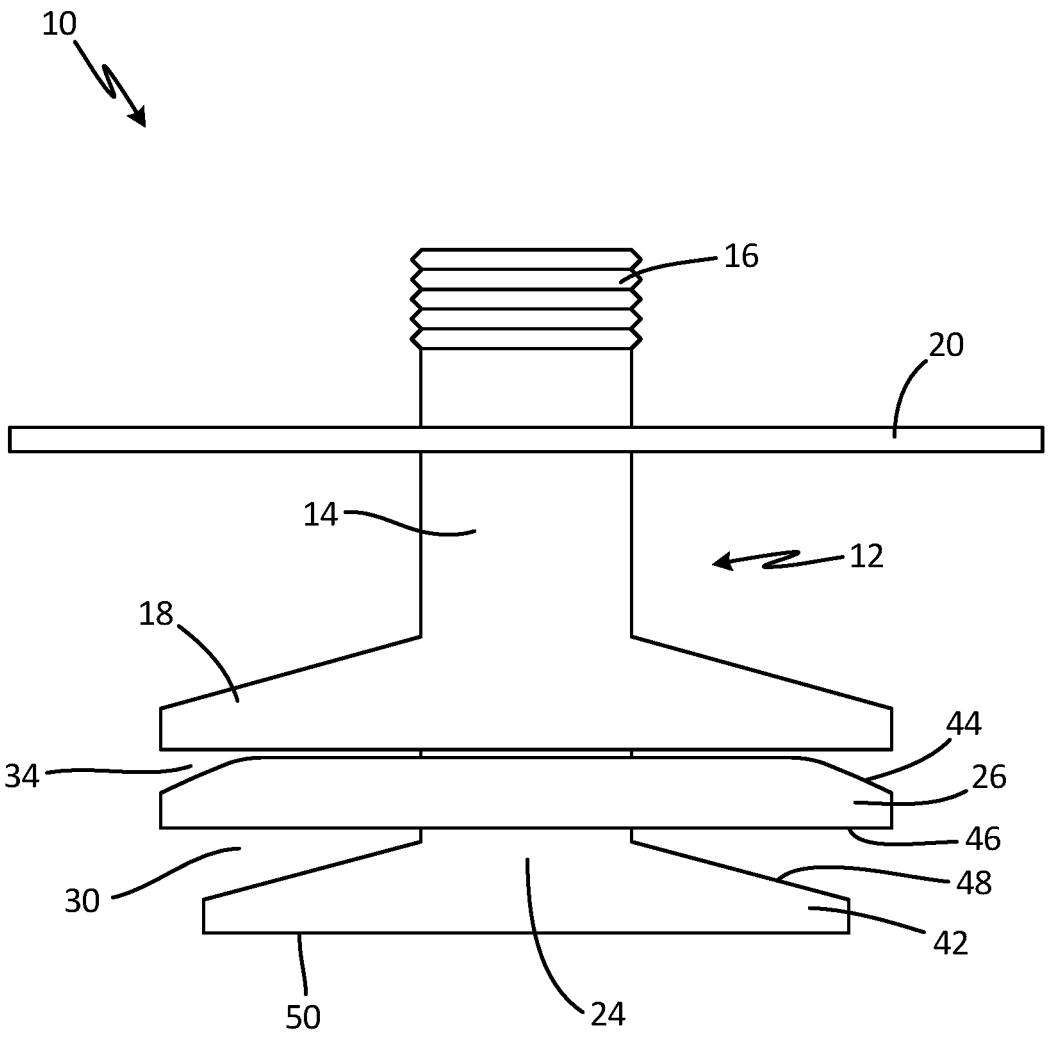
FIG. 1A is a front view of a fire suppression nozzle.
Figure 1B:
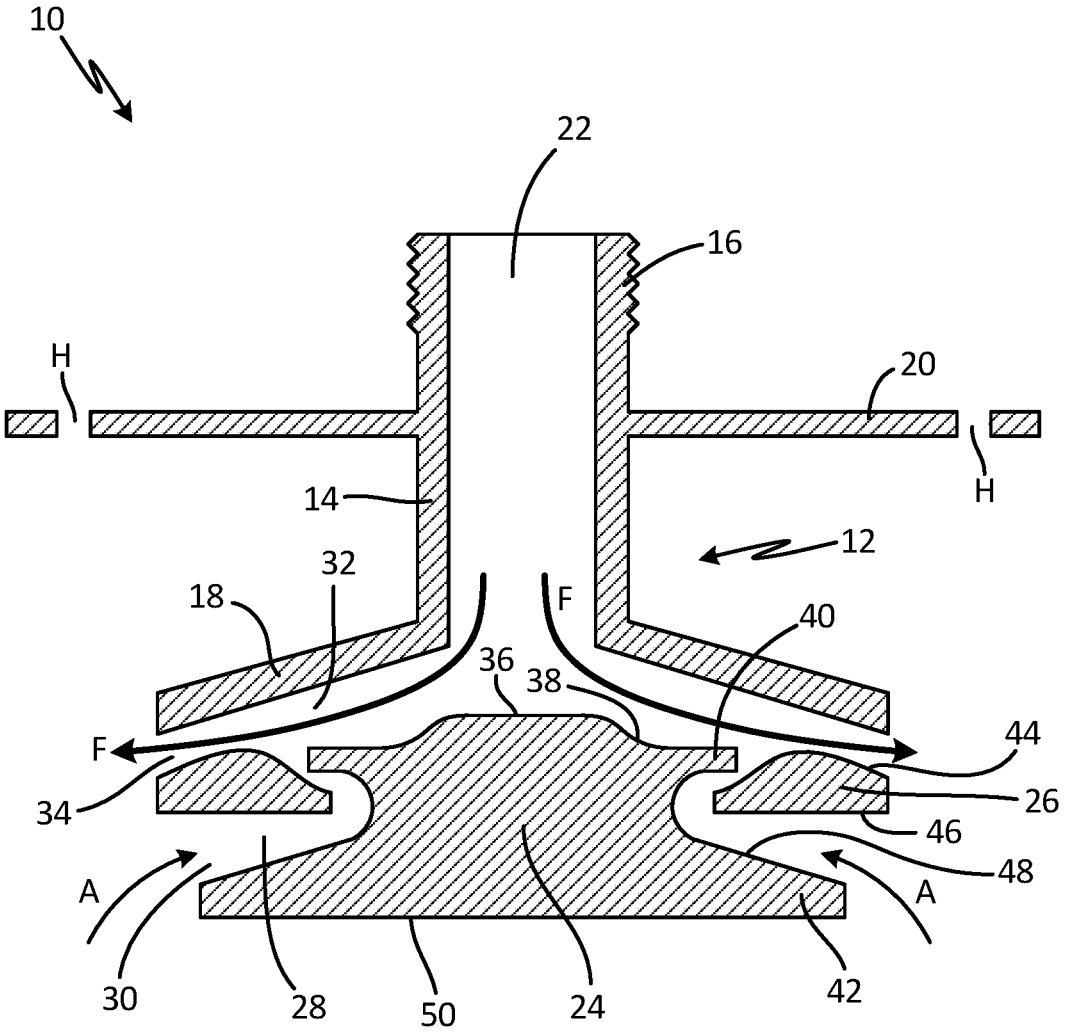
FIG. 1B is a cross-sectional view of the fire suppression nozzle.

FIG. 1A is a front view of fire suppression nozzle 10. FIG. 1B is a cross-sectional view of fire suppression nozzle 10. FIGS. 1A and 1B will be discussed together. Fire suppression nozzle 10 includes body 12 (which includes cylindrical portion 14, threaded portion 16, and conical portion 18), mounting flange 20, main channel 22 (shown in FIG. 1B), flow deflector 24, flow foil ring 26, annular inlet passage 28 (shown in FIG. 1B), annular inlet 30, annular outlet passage 32 (shown in FIG. 1B), and annular outlet 34. Flow deflector 24 includes top portion 36 (shown in FIG. 1B), groove 38 (shown in FIG. 1B), annular flange 40 (shown in FIG. 1B), conical base 42. Flow foil ring 26 includes top surface 44 and bottom surface 46. Conical base 42 has sloped portion 48 and bottom surface 50. Also shown in FIG. 1B are holes H, fire suppression agent F and airflow A.

Body 12 has cylindrical portion 14 with threaded portion 16 at a first end of cylindrical portion 14 and conical portion 18 at a second end of cylindrical portion 14. Conical portion 18 slopes away from cylindrical portion 14. Mounting flange 20 is connected to cylindrical portion 14 of body 12 between threaded portion 16 and conical portion 18. Mounting flange 20 is circular with three or four mounting holes H extending through mounting flange 20. In this embodiment, mounting flange 20 is the same unitary piece as body 12. In alternate embodiments, mounting flange 20 may be a separate piece that is welded, machined, or connected to body 12 using any other suitable means. Main channel 22 is an annular channel that extends through cylindrical portion 14 of body 12 from the first end of cylindrical portion 14 to the second end of cylindrical portion 14. Flow deflector 24 is connected to the second end of cylindrical portion 14 of body 12 with a portion of flow deflector 24 being in alignment with main channel 22. Flow deflector 24 is connected such that a space exists between the second end of cylindrical portion 14 and flow deflector 24. Flow foil ring 26 is positioned adjacent conical portion 18 of body 12 and flow deflector 24. A periphery of flow foil ring 26 has a diameter about the same as the diameter of a periphery of conical portion 18. Flow foil ring 26 is a ring having an airfoil-shaped cross-section. Flow foil ring 26 is connected to flow deflector 24 such that annular inlet passage 28 is formed between flow deflector 24 and flow foil ring 26. Annular inlet 30 is at a radially outer end of annular inlet passage 28. Annular outlet passage 32 is formed between conical portion 18 of body 12, flow deflector 24 and flow foil ring 26 such that conical portion 18 forms a first side of annular outlet passage 32 and flow deflector 24 and flow foil ring 26 form a second side of annular outlet passage 32. Annular outlet 34 is at a radially outer end of annular outlet passage 32. Annular outlet 34 is formed between conical portion 18 and flow foil ring 26. Annular outlet 34 extends radially outward further than annular inlet 30. Fire suppression nozzle 10 is made from metal, such as 321 stainless steel, or any other suitable fire-proof material. In one embodiment, fire suppression nozzle 10 is made using additive manufacturing.

Flow deflector 24 has top portion 36 at a first end or interior end of flow deflector 24. Top portion 36 is adjacent cylindrical portion 14 of body 12. Top portion 36 is in alignment with main channel 22. Top portion 36 has a circular top surface. Top portion 36 slopes down into groove 38. Groove 38 is an annular groove in a side of flow deflector 24 adjacent top portion 36. Groove 38 is also adjacent annular flange 40 such that groove 38 is between top portion 36 and annular flange 40. Annular flange 40 is an annular flange that extends out of the side of flow deflector 24. Annular flange 40 extends over a top of a portion of flow foil ring 26. Top portion 36, groove 38, and annular flange 40 form a portion of annular outlet passage 32. Conical base 42 is at a second end or exterior end of flow deflector 24. Conical base 42 extends out of the side of flow deflector 24 between annular flange 40 and the exterior end of flow deflector 24 at an angle sloped away from the side of flow deflector 24. Conical base 24 has a flat bottom surface that also makes up the bottom surface of the exterior end of flow deflector 24. A periphery of conical base 24 has a smaller diameter than the periphery of conical portion 18 and the periphery flow foil ring 26.

Flow foil ring 26 has top surface 44 at a top of flow foil ring 26 and bottom surface 46 at a bottom of flow foil ring 26. Top surface 44 is curved and bottom surface 26 is flat such that flow foil ring 26 has an airfoil-shaped cross-section. Top surface 44 forms a portion of the second side of annular outlet passage 32. Bottom surface 46 forms a first side of annular inlet passage 28.

Conical base 42 has sloped portion 48 that extends out of the side of flow deflector 24 away from the side of flow deflector 24. Sloped portion 48 is adjacent bottom surface 50, which is flat and makes up the bottom surface of flow deflector 24. Sloped portion 48 forms a second side of annular inlet passage 28.

Fire suppression nozzle 10 is mounted to a wall or ceiling of a cargo hold. Conical portion 14 fits through an opening in the wall or ceiling of the cargo hold, extending in about 1 inch or 2.54 centimeters, and threaded portion 16 couples with another threaded portion within the opening. Mounting flange 20 is adjacent the wall or ceiling of the cargo hold and marries to the wall or ceiling of the cargo hold. More specifically, fasteners extend through holes in mounting flange 20 and into the wall or ceiling such that fire suppression nozzle 10 is mounted to the wall or ceiling and prevented from moving.

Fire suppression agent F, which may be Halon or any other suitable fire suppression agent, moves through plumbing within the wall or ceiling and into fire suppression nozzle 10 through main channel 22. As fire suppression agent F in main channel 22 reaches the second end of cylindrical portion 14, fire suppression agent F contacts top portion 36 of flow deflector 24. Flow deflector 24 deflects fire suppression agent F radially outward. Fire suppression agent F disperses 360 degrees around circular top portion 36 and flows through annular outlet passage 32. As fire suppression agent F flows through annular outlet passage 32, fire suppression agent moves between a bottom surface of conical portion 18 and groove 38, annular flange 40, and top surface 44 of flow foil ring 26. Because top surface 44 is curved such that flow foil ring 26 has an airfoil-shaped cross-section, fire suppression agent F flows at a higher velocity at top surface 44 of flow foil ring 26, causing lift or suspension of fire suppression agent F. As the velocity of fire suppression agent F increases, the pressure decreases. As fire suppression agent F reaches annular outlet 34, fire suppression agent F disperses out of fire suppression nozzle 10 and into the cargo hold at 360 degrees.

Because bottom surface 46 of flow foil ring 26 is flat and sloped portion 48 of conical base 42 extends away from flow deflector 42 at an angle, annular inlet passage 28 has a cross-sectional area that increases moving radially out from flow deflector 24 such that annular inlet passage 28 has the greatest cross-sectional area at annular inlet 30. Annular inlet passage 28 entrains airflow A via a Venturi effect. More specifically, as the cross-sectional area of annular inlet passage 28 decreases, the velocity of airflow A within annular inlet passage 28 increases, resulting in a pressure drop in annular outlet passage 32. Such a pressure drop draws fire suppression agent F through annular outlet passage 32 and out annular outlet 34. The pressure differential between annular inlet passage 28 and annular outlet passage 32 induces airflow A into and through annular inlet passage 28, as airflow A moves from an area of higher pressure to an area of lower pressure. Airflow A mixes with fire suppression agent F within fire suppression nozzle 10 between flow deflector 24 and flow foil ring 26. Consequently, fire extinguishing agent F exiting at annular outlet 34 is mixed with airflow A and has a turbulent flow pattern.

Annular outlet 34 allowing for 360 degree dispersion of fire suppression agent F produces greater and more even dispersion of fire suppression agent F. As such, less fire suppression nozzles 10 are required in the cargo hold. Additionally, any debris coming down main channel 22 will not get lodged in fire suppression nozzle 10 or inhibit dispersion of fire suppression agent F. Annular outlet 34 does not become plugged by debris or contamination because it extends 360 degrees. Furthermore, the lift created in annular outlet passage 32 causes any debris or contamination present in fire suppression nozzle 10 to be lifted along with fire suppression agent F and transported or cleared from fire suppression nozzle 10, reducing blockage of annular outlet 34. Likewise, the lift or suspension created by flow foil ring 26 prevents fire suppression agent from dragging along or experiencing friction with top surface 44. Moreover, because fire suppression nozzle 10 can be additively manufactured, it is easier to produce and less expensive.

Flow deflector 24 serves to route airflow A and fire suppression agent F. Mixing airflow A with fire suppression agent F dilutes fire suppression agent F, reducing localized build ups of high concentrations of fire suppression agent F. Further, fire suppression agent F is heavier than the ambient air and thus moves down toward a floor or bottom surface of the cargo hold. Aspirating airflow A and mixing airflow A with fire suppression agent F also creates a turbulent airflow pattern around the proximity of fire suppression nozzle 10. The turbulent airflow pattern agitates or stirs airflow A and fire suppression agent F and prevents fire suppression agent F from falling to the floor as quickly. Airflow A can also prevent fire suppression agent F from freezing up on top surface 44. Additionally, a back pressure wave is created by entraining airflow A, which restricts fire suppression agent F from flowing out of fire suppression nozzle 10 as quickly. Fire suppression agent F flowing out of fire suppression nozzle 10 at a reduced rate assists in equalizing pressure, reducing localized pressure build ups in the cargo hold. As such, mixing airflow A with fire suppression agent F results in a more even and more effective distribution of fire suppression agent F.

Figure 2:
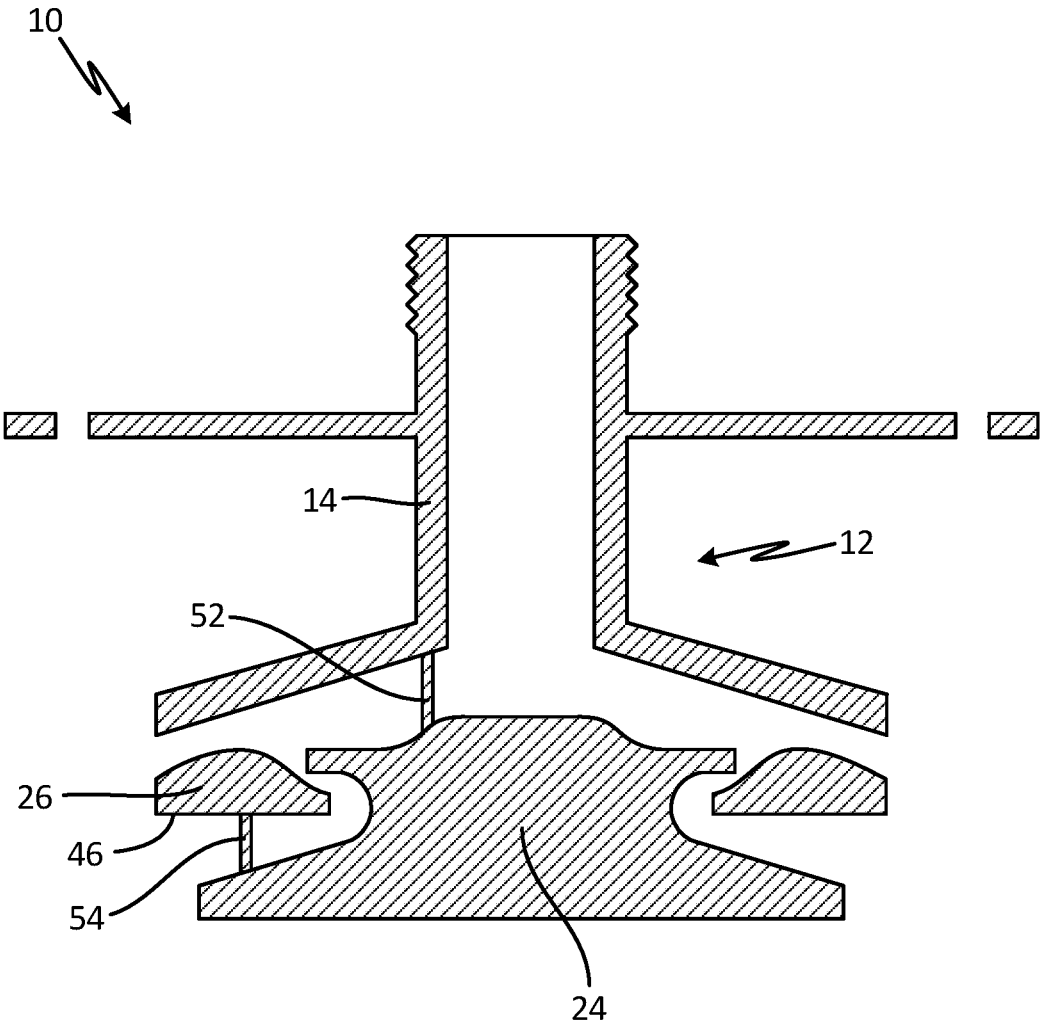
FIG. 2 is a cross-sectional view of the fire suppression nozzle showing posts.

FIG. 2 is a cross-sectional view of fire suppression nozzle 10 showing posts 52 and 54. Fire suppression nozzle 10 includes body 12, with cylindrical portion 14, flow deflector 24, flow foil ring 26, bottom surface 46, posts 52, and posts 54.

As described in reference to FIGS. 1A and 1B, body 12 has cylindrical portion 14 and flow deflector 24 is connected to the second end of cylindrical portion 14. Flow foil ring 26 is positioned adjacent body 12 and flow deflector 24 and is connected to flow deflector 24. First ends of posts 52 are attached to the second end of cylindrical portion 14 and second ends of posts 52 are attached to flow deflector 24. Posts 52 are very small and do not disrupt 360 degree dispersion of fire suppression agent F. Posts 52 are rod-shaped. Posts 52 may have a cross-section that is circular, rectangular, or any other suitable shape. In this embodiment, fire suppression nozzle 10 has 3 posts 52. In alternate embodiments, fire suppression nozzle 10 may have any suitable number of posts 52. First ends of posts 54 are attached to bottom surface 46 of flow foil ring 26 and second ends of posts 54 are attached to flow deflector 24. Posts 54 are very small. Posts 54 are rod-shaped. Posts 54 may have a cross-section that is circular, rectangular, or any other suitable shape. In this embodiment, fire suppression nozzle 10 has 3 posts 54. In alternate embodiments, fire suppression nozzle 10 may have any suitable number of posts 54.

Posts 52 connect cylindrical portion 14 of body 12 and flow deflector 24. Posts 54 connect flow foil ring 26 and flow deflector 24. Posts 52 hold flow deflector 24 in place, and posts 54 hold flow foil ring 26 in place. Fire suppression nozzle 10 is one unitary piece that can be additively manufactured.

Figure 3:
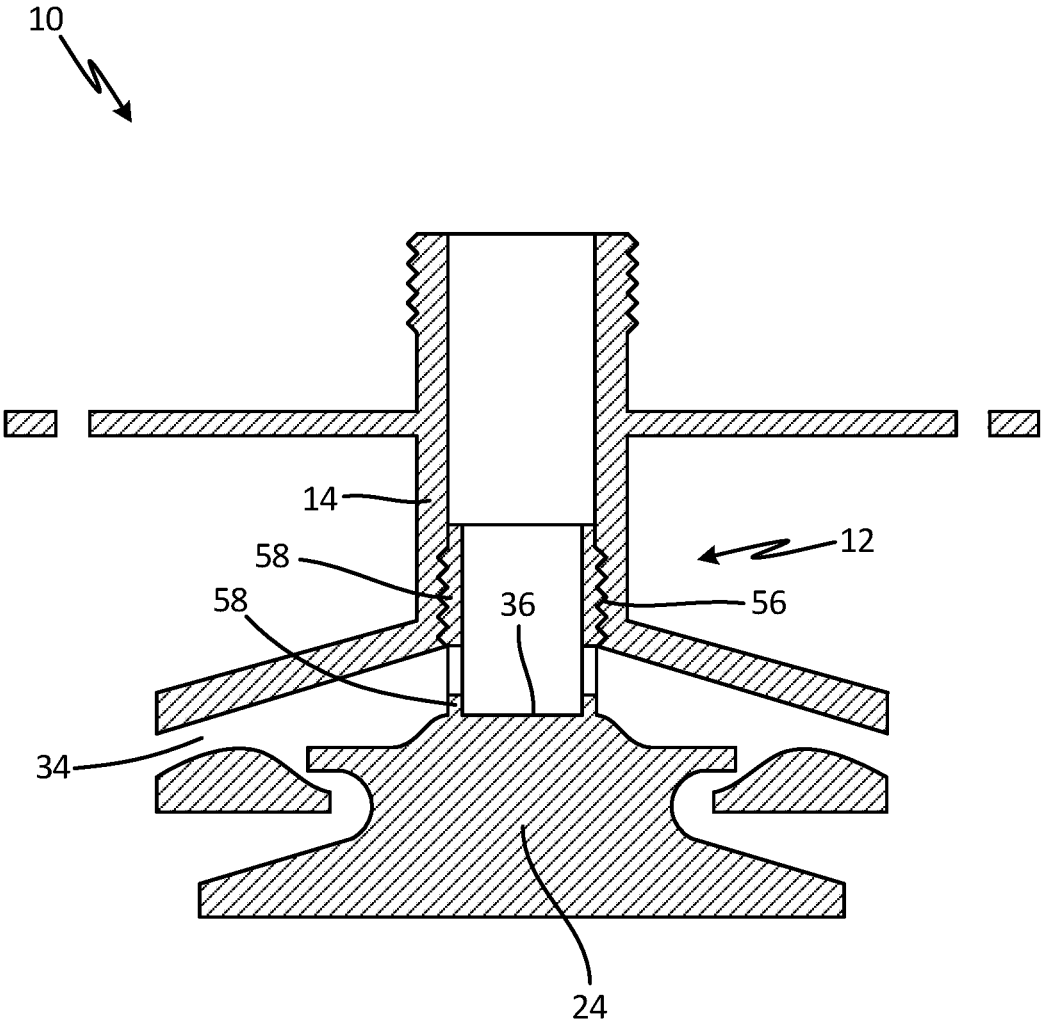
FIG. 3 is a cross-sectional view of the fire suppression nozzle showing threaded portions.

FIG. 3 is a cross-sectional view of the fire suppression nozzle 10 showing threaded portions 56 and 58, which connected flow deflector 24 to body 12. Fire suppression nozzle 10 includes body 12, with cylindrical portion 14, which has threaded portion 56, flow deflector 24, which has top portion 36 and threaded portion 58, and annular outlet 34.

As described in reference to FIGS. 1A and 1B, body 12 has cylindrical portion 14 and flow deflector 24 is connected to the second end of cylindrical portion 14. Cylindrical portion 14 has threaded portion 56 on an internal portion of cylindrical portion 14 at a second end of cylindrical portion 14. Flow deflector 24 has top portion 36 at a first end or interior end of flow deflector 24. A first end of threaded portion 58 is connected to top portion 36 of flow deflector 24 and a second end of threaded portion 58 has threads that are configured to mate with threaded portion 56. As such, threaded portion 56 and threaded portion 58 are connected. Threaded portion 58 has a space between the first end of threaded portion 58 and the second end of threaded portion 58 such that threaded portion 58 does not disrupt 360 degree dispersion of fire suppression agent F.

Threaded portion 58 connects cylindrical portion 14 of body 12 and flow deflector 24. The mating of threaded portion 56 and threaded portion 58 can be adjusted to adjust annular outlet 34 of fire suppression nozzle 10. Additionally, threaded portion 56 and threaded portion 58 can be disengaged to remove and replace flow deflector 24.

Discussion of Possible Embodiments

The following are non-exclusive descriptions of possible embodiments of the present invention.

A fire suppression nozzle includes a body including: a cylindrical portion having a first end and a second end; and a conical portion connected to the second end of the cylindrical portion; a main channel extending through the cylindrical portion; a flow deflector connected to the body, the flow deflector including: a top portion in alignment with the main channel; an annular flange extending out of a side of the flow deflector; and a conical base extending out of the side of the flow deflector at an angle; and a flow foil ring positioned adjacent the flow deflector and the conical portion of the body.

The fire suppression nozzle of the preceding paragraph can optionally include, additionally and/or alternatively, any one or more of the following features, configurations and/or additional components:

An annular outlet formed between the conical portion of the body and the flow foil ring.

An annular inlet formed between the conical base and the flow foil ring.

The body further includes a threaded portion at the first end of the cylindrical portion.

A mounting flange connected to the cylindrical portion of the body.

The fire suppression nozzle is made using additive manufacturing.

The flow foil ring is connected to the flow deflector via a post.

The flow deflector is connected to the body via a post.

The flow deflector further includes a threaded portion and the flow deflector is connected to the body via mating between the threaded portion of the flow deflector and a threaded portion on an internal portion of the cylindrical portion.

The flow deflector includes a groove between the top portion and the annular flange.

An annular outlet passage formed by the conical portion of the body, the top portion of the flow deflector, and the top of the flow foil ring.

An annular inlet passage formed by a sloped portion of the conical base of the flow deflector and a bottom surface of the flow foil ring.

The flow foil ring has an airfoil-shaped cross-section.

The flow foil ring has a curved top surface and a flat bottom surface.

The conical base has a flat bottom surface.

A fire suppression nozzle includes a body; a main channel extending through the body; a flow deflector connected to the body; a flow foil ring between the flow deflector and the body; an annular outlet between the body and the flow foil ring; and an annular inlet between the flow foil ring and a conical base of the flow deflector.

The fire suppression nozzle of the preceding paragraph can optionally include, additionally and/or alternatively, any one or more of the following features, configurations and/or additional components:

The flow foil ring has an airfoil-shaped cross-section.

The annular outlet is configured to disperse fire suppression agent 360 degrees.

An annular inlet passage between the flow foil ring and the conical base of the flow deflector, wherein the annular inlet passage is configured to entrain ambient air.

An annular outlet passage between the body, the flow deflector, and the flow foil ring, wherein the annular outlet passage is configured to increase the velocity of fire suppression agent exiting the fire suppression nozzle at annular outlet.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fire suppression nozzle comprising:

a body including:

a cylindrical portion having a first end and a second end; and a conical portion connected to the second end of the cylindrical portion;

a main channel extending through the cylindrical portion for receiving fire suppression agent;

a flow deflector connected to the body, the flow deflector including:

a top portion in alignment with the main channel;

an annular flange extending out of a side of the flow deflector; and a conical base extending out of the side of the flow deflector at an angle;

a flow foil ring positioned between the flow deflector and the conical portion of the body, wherein the flow foil ring has an airfoil-shaped cross-section such that an entire bottom surface of the flow foil ring is flat and a top surface of the flow foil ring is curved;

an annular inlet passage formed by a sloped portion of the conical base of the flow deflector and the flat bottom surface of the flow foil ring; and an annular outlet passage formed by the conical portion of the body, the top portion and the annular flange of the flow deflector, and the curved top surface of the flow foil ring, wherein the fire suppression agent flows at a higher velocity at the curved top surface of the flow foil ring than at the annular flange of the flow deflector.

2. The fire suppression nozzle of claim 1, further including an annular outlet formed between the conical portion of the body and the flow foil ring.

3. The fire suppression nozzle of claim 1, further including an annular inlet formed between the conical base and the flow foil ring.

4. The fire suppression nozzle of claim 1, wherein the body further includes a threaded portion at the first end of the cylindrical portion.

5. The fire suppression nozzle of claim 1, further including a mounting flange connected to the cylindrical portion of the body.

6. The fire suppression nozzle of claim 1, wherein the flow foil ring is connected to the flow deflector via a post.

7. The fire suppression nozzle of claim 1, wherein the flow deflector is connected to the body via a post.

8. The fire suppression nozzle of claim 1, wherein the flow deflector further includes a threaded portion and the flow deflector is connected to the body via mating between the threaded portion of the flow deflector and a threaded portion on an internal portion of the cylindrical portion.

9. The fire suppression nozzle of claim 1, wherein the flow deflector includes a groove between the top portion and the annular flange.

10. The fire suppression nozzle of claim 1, wherein the conical base has a flat bottom surface.

11. A fire suppression nozzle comprising:

a body;

a main channel extending through the body for receiving fire suppression agent;

a flow deflector connected to the body;

a flow foil ring between the flow deflector and the body, wherein the flow foil ring has an airfoil-shaped cross-section such that an entire bottom surface of the flow foil ring is flat and a top surface of the flow foil ring is curved;

an annular outlet between the body and the flow foil ring;

an annular inlet between the flow foil ring and a conical base of the flow deflector;

an annular inlet passage between the flow foil ring and the conical base of the flow deflector, wherein the annular inlet passage is configured to entrain ambient air; and an annular outlet passage between the body, the flow deflector, and the curved top surface of the flow foil ring, wherein the fire suppression agent flows at a higher velocity at the curved top surface of the flow foil ring than at an upstream portion of the flow deflector.

12. The fire suppression nozzle of claim 11, wherein the annular outlet is configured to disperse fire suppression agent 360 degrees.

* * * * *